US012115413B2

(12) United States Patent
McHugh et al.

(10) Patent No.: US 12,115,413 B2
(45) Date of Patent: Oct. 15, 2024

(54) EXERCISE AND THERAPY POOL STRUCTURE

(71) Applicant: HydroWorx International, Inc., Middletown, PA (US)

(72) Inventors: Michael McHugh, Hummelstown, PA (US); Carl E. Rudy, Halifax, PA (US)

(73) Assignee: HYDROWORX INTERNATIONAL, INC., Middletown, PA (US)

( * ) Notice: Subject to any disclaimer, the term of this patent is extended or adjusted under 35 U.S.C. 154(b) by 28 days.

(21) Appl. No.: 17/209,588

(22) Filed: Mar. 23, 2021

(65) Prior Publication Data

US 2022/0305329 A1 Sep. 29, 2022

(51) Int. Cl.

| | |
|---|---|
| ***A63B 22/02*** | (2006.01) |
| ***A63B 21/008*** | (2006.01) |
| ***E04H 4/00*** | (2006.01) |

(52) U.S. Cl.

CPC ..... *A63B 22/0235* (2013.01); *E04H 4/0043* (2013.01); *A63B 21/0084* (2013.01); *A63B 2208/03* (2013.01)

(58) Field of Classification Search

CPC ... E04H 4/0031; E04H 4/0075; E04H 4/0081; E04H 4/0087; E04H 4/0093; E04H 4/1236; A63B 22/02; A63B 22/0207; A63B 22/0214; A63B 22/0221; A63B 22/0228; A63B 22/0235; A63B 22/0242; A63B 22/025; A63B 22/0257; A63B 22/0264; A63B 22/0285

See application file for complete search history.

(56) References Cited

U.S. PATENT DOCUMENTS

| | | | | |
|---|---|---|---|---|
| D251,201 | S | 2/1979 | Mathis | |
| 4,938,469 | A * | 7/1990 | Crandell | A63B 22/025 4/492 |
| 4,944,506 | A * | 7/1990 | Keller | A63B 22/02 D24/188 |
| 5,558,604 | A * | 9/1996 | Hopkins | A63B 22/0264 482/111 |
| 5,727,264 | A | 3/1998 | Craig et al. | |
| 5,921,892 | A * | 7/1999 | Easton | A63B 22/02 482/54 |
| D417,286 | S | 11/1999 | Sullivan | |
| 6,217,487 | B1 * | 4/2001 | Reinert | A63B 22/0005 482/54 |
| 6,746,375 | B2 * | 6/2004 | Smith | A01K 15/027 119/700 |
| 7,086,994 | B2 * | 8/2006 | Turak | A63B 22/0242 482/54 |
| 7,241,250 | B1 * | 7/2007 | French | A63B 22/0235 482/54 |

(Continued)

FOREIGN PATENT DOCUMENTS

| | | |
|---|---|---|
| KR | 100574469 | 4/2006 |

*Primary Examiner* — Zachary T Moore

(74) *Attorney, Agent, or Firm* — Ballard Spahr LLP

(57) ABSTRACT

A pool structure uses an installation to receive a treadmill within the pool. The installation has a pan which is embedded within the floor of the pool. A duct projects from the pan through a sidewall of the pool. A motor uses a mechanical transmission extending through the sidewall to provide motive power to the treadmill. Anchoring studs, which are drilled into the pool floor, are attached to the pan via a structural angle weldment.

48 Claims, 5 Drawing Sheets

(56) References Cited

U.S. PATENT DOCUMENTS

| | | | | |
|---|---|---|---|---|
| 7,984,519 | B1 | 7/2011 | Hall | |
| 8,607,372 | B2 | 12/2013 | Hall | |
| 8,747,285 | B2 | 6/2014 | Hof | |
| 8,784,278 | B2 * | 7/2014 | Flake | A61H 33/6026 482/54 |
| 10,072,431 | B2 | 9/2018 | Hall | |
| 10,208,496 | B2 | 2/2019 | Sanchez | |
| 2001/0051563 | A1 * | 12/2001 | Turak | A63B 22/0242 482/54 |
| 2008/0134426 | A1 | 6/2008 | Cronise et al. | |
| 2009/0151066 | A1 | 6/2009 | Sullivan | |
| 2012/0010052 | A1 * | 1/2012 | Hof | A63B 21/0084 482/54 |
| 2013/0014321 | A1 * | 1/2013 | Sullivan | E04H 4/0075 4/506 |
| 2019/0194965 | A1 | 6/2019 | Hall | |

* cited by examiner

EXERCISE AND THERAPY POOL STRUCTURE

FIELD OF THE INVENTION

This invention relates to aquatic pools having equipment for hydrotherapy and exercise.

BACKGROUND

Aquatic/hydro therapy provides proven effective treatment for many health related concerns such as arthritis, fibromyalgia, rehabilitation for orthopedic joint sprains, surgeries and replacements, chronic pain relief, neurological and neuromuscular disorders, as well as a means for effective weight loss and improved balance and stability. Moreover, excellent exercise regimens for the professional athlete as well as the average health conscious individual are realizable using aquatic/hydro therapy equipment.

The effectiveness of aquatic/hydrotherapy provides an incentive for improvements to aquatic/hydrotherapy equipment. Opportunities for improvements in construction techniques, simplicity and efficiency of maintenance, and accommodation of a broad spectrum of users having different physical characteristics are a few examples of progress to be made.

SUMMARY

In one aspect the invention encompasses an installation comprising a pan. In an example embodiment the pan comprises a floor panel and a plurality of side panels attached thereto. The side panels extend transversely to the floor panel and define a receiving space between the floor panel and the side panels. An opening is positioned in one of the side panels. A duct has an open end attached to the pan at the opening. The duct extends transversely to the one side panel. Further by way of example a plurality of mounting brackets may be affixed to the floor panel. A frame surrounds the receiving space in example embodiments. A treadmill may be positioned within the receiving space. A pair of railings may be positioned in space relation on opposite sides of the treadmill.

An example installation may further comprise a motor positioned adjacent to the duct. A mechanical transmission extends through the duct. The mechanical transmission connects the motor to the treadmill for providing motive power thereto. In a particular example embodiment the mechanical transmission comprises a pulley assembly. In an example a plurality of studs are attached to and extend from the pan. By way of example the pay may comprise four side panels.

The invention also encompasses a pool structure. An example pool structure embodiment comprises a pool floor. A plurality of sidewalls are attached to one another and the pool floor. The sidewalls extend transversely to the pool floor and define a water receiving volume therebetween. A first pan is attached to the pool floor adjacent to one of the sidewalls. The first pan comprises a first floor panel and a plurality of first side panels attached thereto. The first side panels extend transversely to the first floor panel and define a first receiving space between the first floor panel and the first side panels. A first opening is positioned in one of the first side panels. A first duct has an open end attached to the first pan at the first opening. The first duct extends transversely to the one first side panel and through the one sidewall adjacent to the first pan, thereby positioning an opposite end of the first duct outside of the water receiving volume.

In an example embodiment a first treadmill is positioned within the first receiving space. By way of example the pool structure may further comprises a pair of railings positioned in spaced relation on opposite sides of the first treadmill. A motor is positioned adjacent to the first duct and a mechanical transmission extends through the first duct. The mechanical transmission connects the motor to the first treadmill for providing motive power thereto. In an example embodiment the mechanical transmission comprises a pulley assembly. Further by way of example a jet port is positioned in the one sidewall adjacent to the first pan. The jet port is aligned with the first treadmill. In an example embodiment the first pan is embedded within the pool floor. By way of example a plurality of studs are attached to and extend from the first pan. The studs are embedded within the pool floor.

In an example embodiment the pool floor has an upper surface, and the first treadmill has a belt positioned flush with the upper surface. Further by way of example a frame surrounds the first treadmill. The frame is positioned flush with the upper surface in an example embodiment. A plurality of mounting brackets may be affixed to the first floor panel. In a specific example embodiment the pool floor and the plurality of sidewalls are formed of concrete, gunite or shotcrete. Further by way of example, the pool structure may further comprise a second pan attached to the pool floor adjacent to one of the sidewalls. The second pan comprises a second floor panel and a plurality of second side panels attached thereto. The second side panels extend transversely to the second floor panel and define a second receiving space between the second floor panel and the second side panels. A second opening is positioned in one of the second side panels. A second duct has an open end attached to second pan at the second opening. The second duct extends transversely to the one second side panel and through the one sidewall adjacent to the second pan, thereby positioning an opposite end of second duct outside of the water receiving volume in this example.

By way of example a second treadmill may be positioned within the second receiving space. A pair of railings may be positioned in spaced relation on opposite sides of the second treadmill. In a further example embodiment, the pool structure comprises a motor positioned adjacent to the second duct. A mechanical transmission extends through the second duct. The mechanical transmission connects the motor to the second treadmill for providing motive power thereto. In an example embodiment the mechanical transmission comprises a pulley assembly. In an example embodiment a jet port is positioned in the one sidewall adjacent to the second pan. The jet port is aligned with the second treadmill. By way of example the second pan is embedded within the pool floor. In a further example a plurality of studs are attached to and extend from the second pan. The studs are embedded within the pool floor in this example embodiment. The pool floor has an upper surface in this example, and the second treadmill has a belt positioned flush with the upper surface. Further by way of example, a frame surrounds the second treadmill. The frame is positioned flush with the upper surface in an example embodiment. A plurality of mounting brackets may be affixed to the second floor panel in an example.

In another example embodiment according to the invention, a pool structure comprises a pool floor. A plurality of sidewalls are attached to one another and the pool floor. The sidewalls extend transversely to the pool floor and define a water receiving volume therebetween. A first pan is attached to the pool floor adjacent to one of the sidewalls. The first pan comprises a first floor panel and a plurality of first side panels attached thereto. The first side panels extending transversely to the first floor panel and defining a first receiving space between the first floor panel and the first side panels. A first opening is positioned in one of the first side panels. A first duct has an open end attached to the first pan at the first opening. The first duct extends transversely to the one first side panel and through the one sidewall adjacent to the first pan, thereby positioning an opposite end of the first duct outside of the water receiving volume. A second pan is attached to the pool floor adjacent to one of the sidewalls. The second pan comprises a second floor panel and a plurality of second side panels are attached thereto. The second side panels extend transversely to the second floor panel and define a second receiving space between the second floor panel and the second side panels. A second opening is positioned in one of the second side panels. A second duct has an open end attached to the second pan at the second opening. The second duct extends transversely to the one of the second side panels and through the one sidewall adjacent to the second pan, thereby positioning an opposite end of the second duct outside of the water receiving volume.

In an example embodiment a first treadmill is positioned within the first receiving space and a second treadmill positioned within the second receiving space. By way of example the first and second pans are embedded within the pool floor. A plurality of studs are attached to and extend from the first and second pans. The studs are embedded within the pool floor. In an example embodiment the pool floor comprises a first upper surface portion positioned at a first level and a second upper surface portion positioned at a second level. The second level is higher relative to the first level. The first pan is surrounded by the first upper surface portion and the second pan is surrounded by the second upper surface portion.

Further by way of example, the first treadmill has a belt positioned flush with the first upper surface portion and the second treadmill has a belt positioned flush with the second upper surface portion. Also by way of example, a first frame surrounds the first treadmill and a second frame surrounds the second treadmill. In an example embodiment the first frame is positioned flush with the first upper surface portion and the second frame is positioned flush with the second upper surface portion. A first motor is positioned adjacent to the first duct in an example embodiment. A first mechanical transmission extends through the first duct in an example. The first mechanical transmission connects the first motor to the first treadmill for providing motive power thereto. A second motor is positioned adjacent to the second duct, and a second mechanical transmission extends through the second duct in an example. The second mechanical transmission connects the second motor to the second treadmill for providing motive power thereto.

In an example embodiment the first mechanical transmission comprises a first pulley assembly and the second mechanical transmission comprises a second pulley assembly. An example embodiment may further comprise a first pair of railings positioned in spaced relation on opposite sides of the first treadmill and a second pair of railings positioned in spaced relation on opposite sides of the second treadmill. A further example embodiment comprises a first jet port positioned in the one sidewall adjacent to the first pan. The first jet port is aligned with the first treadmill. A second jet port is positioned in the one side wall adjacent to the second pan. The second jet port is aligned with the second treadmill in this example. By way of example the pool floor and the plurality of sidewalls are formed of concrete, gunite or shotcrete.

DETAILED DESCRIPTION

Figure 1:
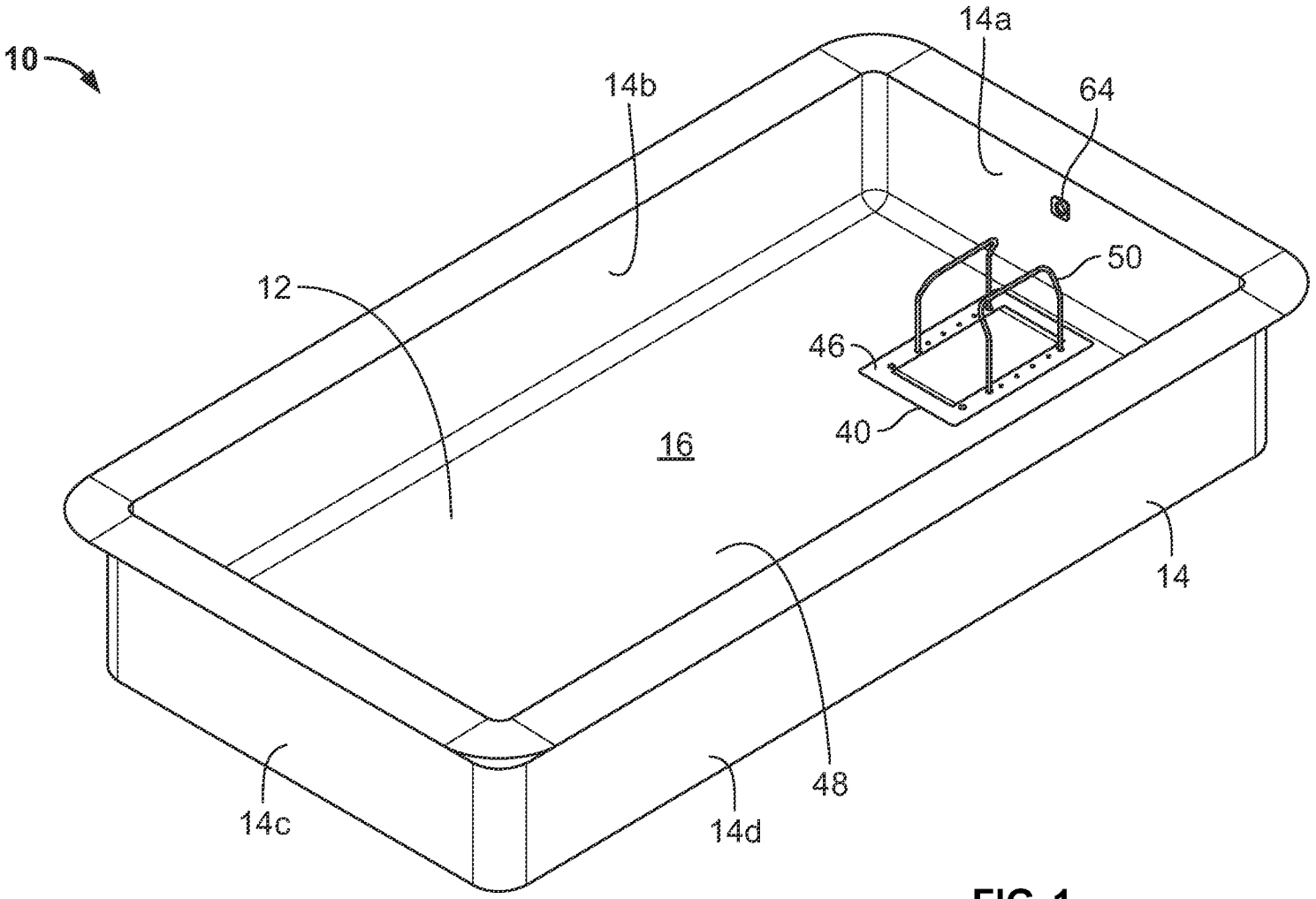
FIG. 1 is an isometric view of an example pool structure according to the invention.

FIG. 1 shows an example pool structure 10 according to the invention. Pool structure 10 is advantageously formed of a reinforcing bar (rebar) framework over which a concrete mixture such as gunite or shotcrete is applied. Pool structure 10 comprises a pool floor 12. A plurality of sidewalls 14, in this example four side walls 14*a*, 14*b*, 14*c* and 14*d*, are attached to one another and to the pool floor 12. The sidewalls 14 extend transversely to the pool floor and define a water receiving volume 16 therebetween.

Figure 2:
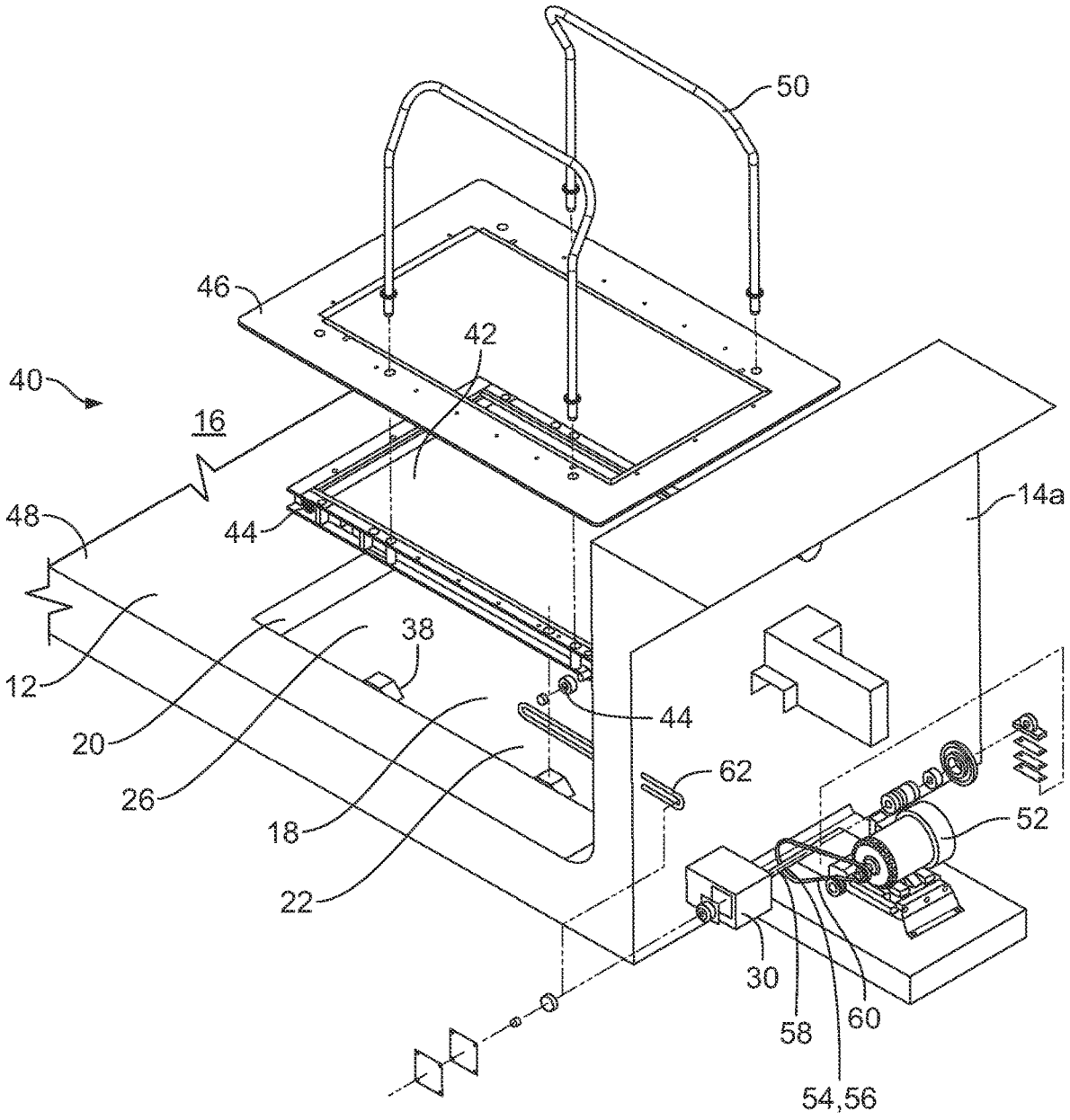
FIG. 2 is an exploded isometric view of a portion of the pool structure shown in FIG. 1.
Figure 3:
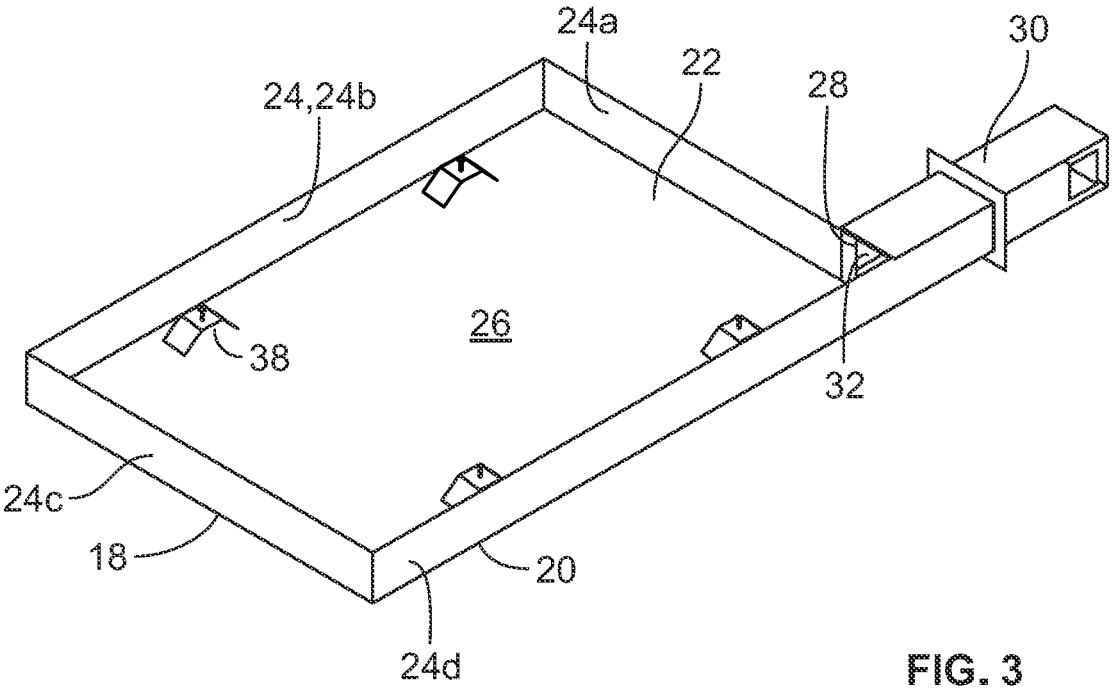
FIG. 3 is an isometric view of an example installation used in the pool structure shown in FIG. 1.

As shown in FIG. 2, an installation 18 is attached to the pool floor 12 adjacent to one of the sidewalls 14*a*. FIG. 3 shows the installation 18 in detail which comprises a pan 20. Pan 20 comprises a floor panel 22 and a plurality of side panels 24 attached thereto. In this example there are four side panels, 24*a*, 24*b*, 24*c* and 24*d*, which extend transversely to the floor panel 22 and define a receiving space 26 between the floor panel 22 and the side panels 24. An opening 28 is positioned in one of the side panels 24*a* and a duct 30 having an open end 32 is attached to the pan 20 at the opening 28. The duct 30 extends transversely to the side panel 24*a* and, as shown in FIG. 4, through the pool sidewall 14*a* adjacent to the pan 20, thereby positioning an opposite end 34 of the duct 30 outside of the water receiving volume 16.

Figure 2A:
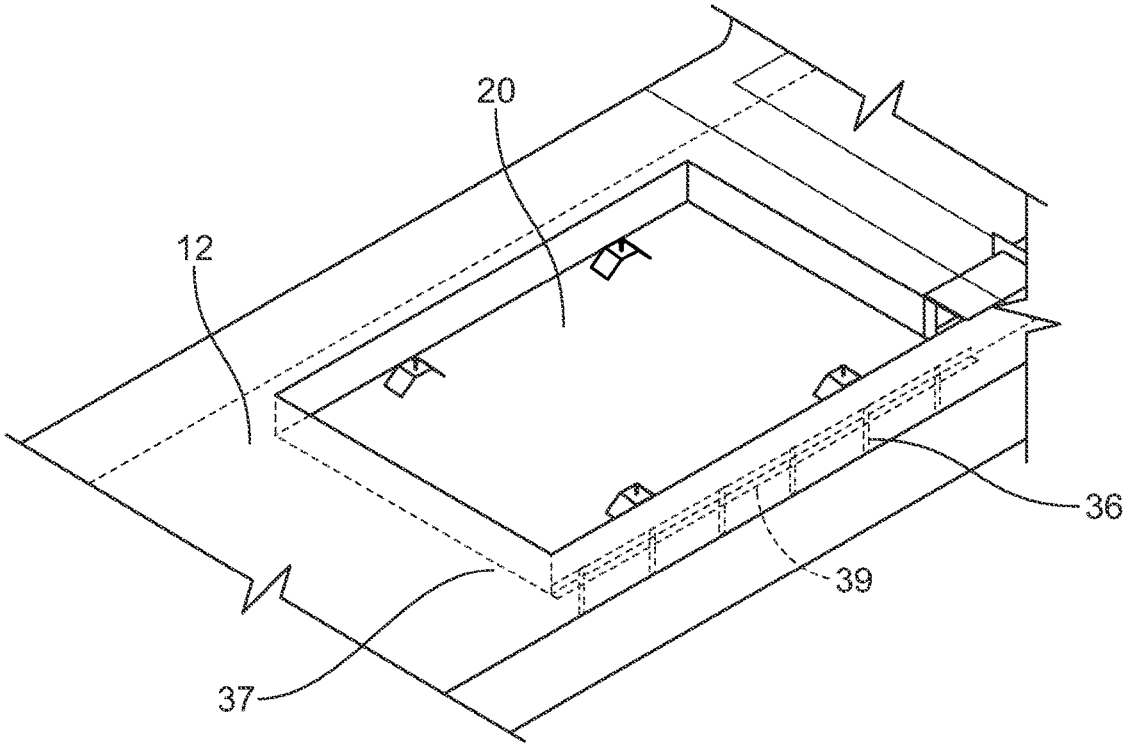
FIG. 2A is an isometric view of a portion of the pool structure shown in FIG. 1.
Figure 2B:
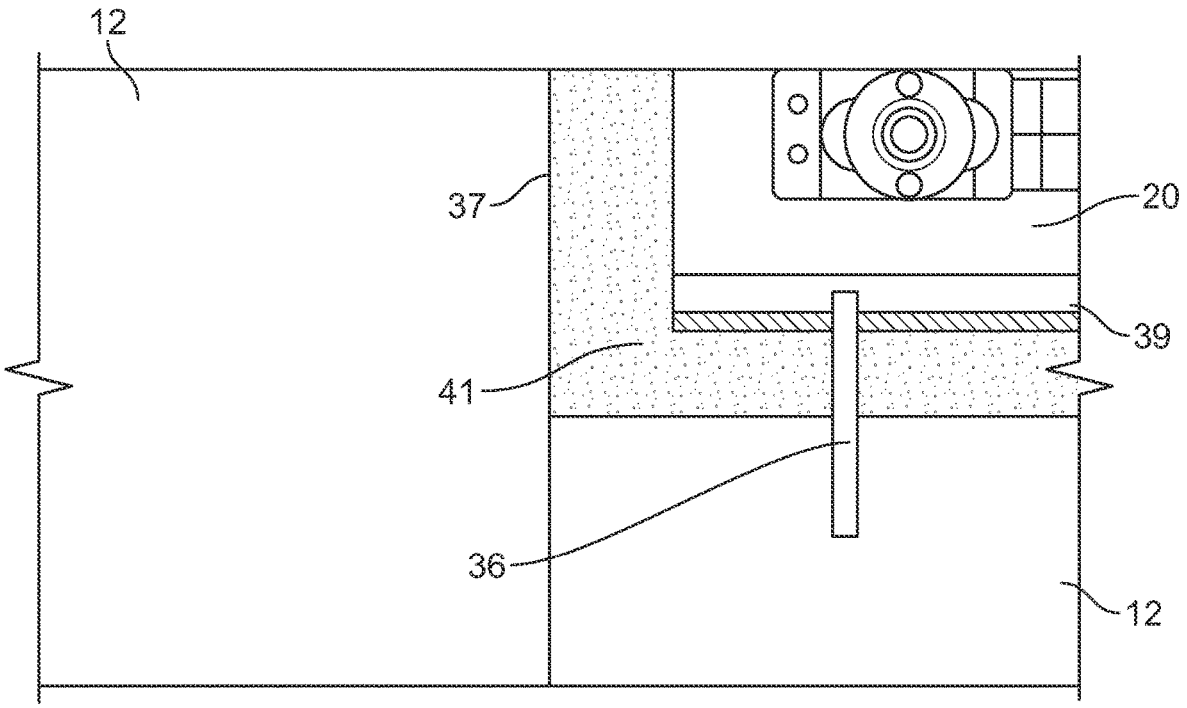
FIG. 2B is a partial sectional view of a portion of the pool structure shown in FIG. 2A.

As shown in FIG. 2A, the pan 20 is advantageously embedded within the pool floor 12 using a plurality of anchoring studs 36. As shown in FIG. 2B, the studs 36 are drilled into the pool floor 12 within a recess 37 sized larger than pan 20. Structural angle elements 39 are placed on the studs 36. The stud and angle assembly is leveled and welded together. Pan 20 is then positioned within the recess 37, welded to the angle elements 39, and the recess 37 is backfilled with grout 41 around the pan. Pan 20 is advantageously formed of stainless steel which allows the installation 18 to be part of a weldment with the stud and angle assembly. As shown in FIGS. 2, 3 and 4, a plurality of mounting brackets 38 may be affixed to the floor panel 22 of pan 20 to permit mounting of a treadmill 40 positioned within the receiving space 26 of pan 20. Example treadmills for aquatic use may be seen in the line of therapy pools provided by HYDROWORX of Middletown, Pennsylvania. Treadmill 40 comprises a moving belt 42 mounted on rollers 44. A frame 46 surrounds the treadmill 40. In this example both the belt 42 and the frame 46 are positioned flush with the upper surface 48 of the pool floor 12 as shown in FIG. 1. Treadmill 40 may further comprise a pair of railings 50 positioned in spaced relation on opposite sides of the treadmill.

Figure 4:
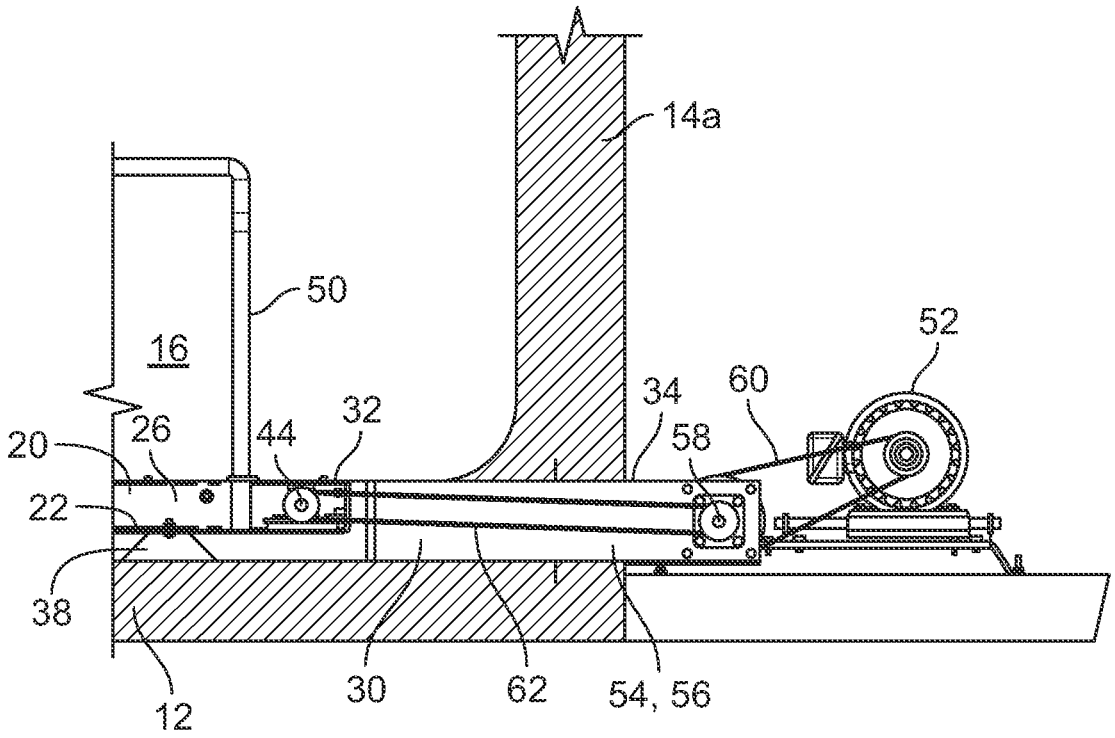
FIG. 4 is a sectional view of a portion of the pool structure shown in FIG. 1.

As shown in FIGS. 2 and 4, treadmill 40 is powered by a motor 52, in this example an electric motor, positioned adjacent to the duct 30 outside of the water receiving volume 16. A mechanical transmission 54 extends through the duct 30 to connect the motor 52 to the treadmill 40 for providing motive power thereto. In this example embodiment the mechanical transmission comprises a pulley assembly 56. Pulley assembly 56 comprises a transmission shaft 58 driven by a belt 60 from the motor 52 which, in turn, drives a second belt 62 which extends through the duct 30 and connects to the drive roller 44 of the treadmill 40. As shown in FIG. 1, the pool structure 10 may also comprise a jet port 64 positioned in the pool sidewall 14*a* adjacent to the pan 20 (not visible). The jet port 64 is aligned with the treadmill 40 and may be used to provide a jet of water against a user of the treadmill for increased resistance to walking on the treadmill.

Figure 5:
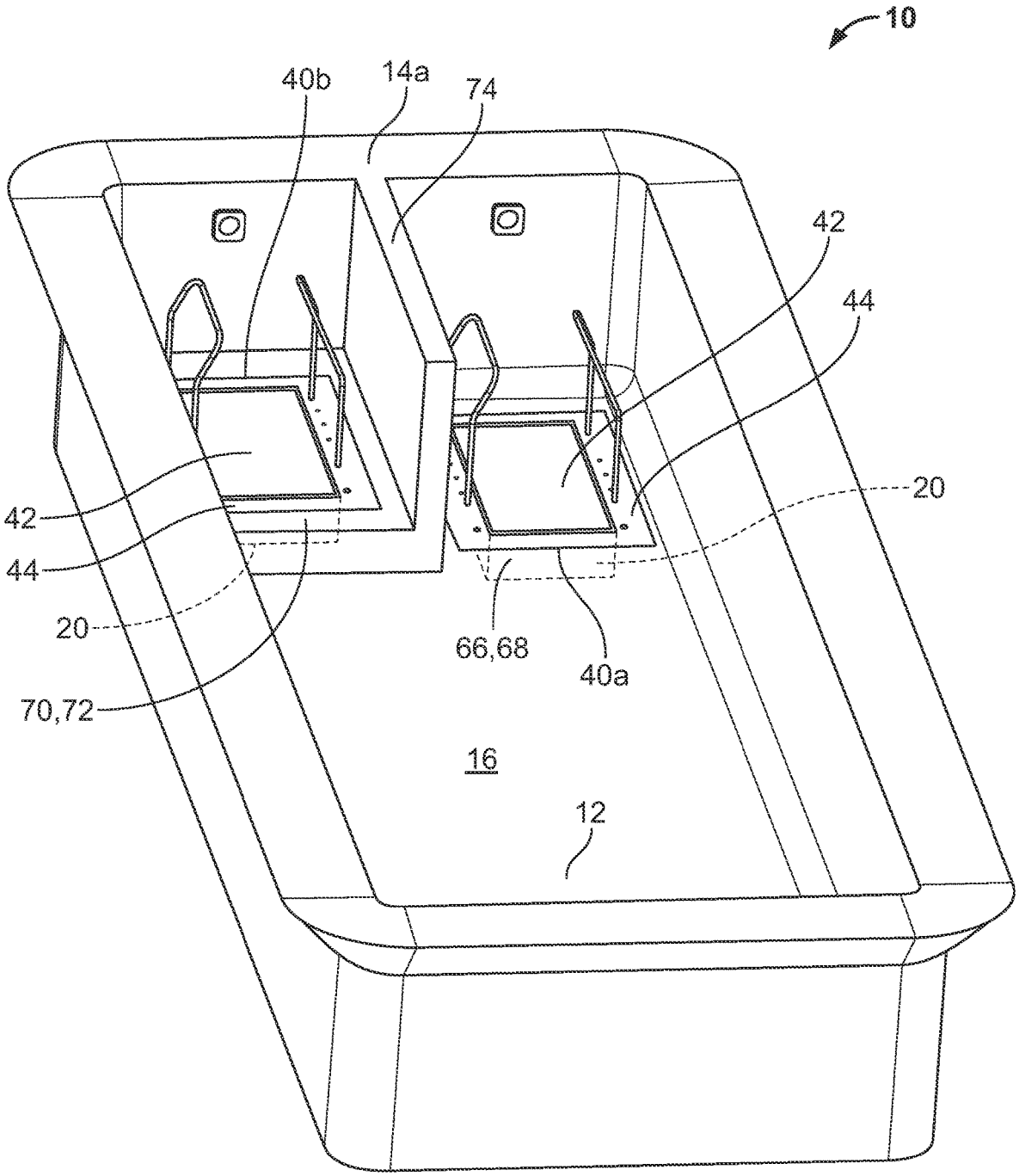
FIG. 5 is an isometric view of another example embodiment of a pool structure according to the invention.

The pool structure 10 according to the invention may comprise multiple embedded installations 18, each receiving a respective treadmill 40 powered by respective motors 52 via respective mechanical transmissions 54. The treadmills 40 may be located side by side along the same pool sidewall 14, or along different side walls, each treadmill having a dedicated jet port 64. When multiple treadmills 40 are used as shown in FIG. 5, it is advantageous to support the various treadmills at different depths within the water receiving volume 16 to accommodate users of different heights. The example pool structure embodiment 10 shown in FIG. 5 has two treadmills 40*a* and 40*b*. To support the treadmills at different depths the pool floor 12 comprises a first upper surface portion 66 positioned at a first level 68 and a second upper surface portion 70 positioned at a second level 72. The second level 72 is higher relative to the first level 68. This effect may be accomplished by making the pool floor 12 thicker in the region of the second upper surface portion 70 as shown. The first pan 20 which receives the first treadmill 40*a* is surrounded by the first upper surface portion 66 and the second pan 20 which receives the second treadmill 40*b* is surrounded by the second upper surface portion. Similar to the example embodiments previously described, the first treadmill 40*a* has a belt 42 and a frame 46 now positioned flush with the first upper surface portion 66, and the second treadmill 40*b* has a belt 42 and a frame 46 positioned flush with the second upper surface portion 70. The difference in height between the first and second levels 68 and 72 has the effect of placing the first treadmill 40*a* deeper within the water receiving volume 16 than the second treadmill 40*b*, thereby allowing the pool structure to accommodate users of different height. The pool structure 10 is of course not limited to two treadmills, as a plurality of treadmills may be installed to accommodate a wide range of user heights. Separating walls 74 may be included in the pool structure to help confine the resistance current from the jet ports 64.

It is expected that pool structures and installations according to the invention will provide safe therapeutic benefits to a wide variety of users as well as a structure which is readily fabricated and efficient to operate and maintain.

What is claimed is:

1. An installation for receiving a treadmill in a pool structure, said installation comprising:

a pan comprising a floor panel and a plurality of side panels attached thereto, said side panels extending transversely to said floor panel and defining a receiving space between said floor panel and said side panels;

an opening positioned in one of said side panels;

a duct having an open end attached to said pan at said opening, said duct extending transversely to said one side panel, said duct configured to extend through a sidewall of said pool structure adjacent to said pan.

2. The installation according to claim 1, further comprising a plurality of mounting brackets affixed to said floor panel.

3. The installation according to claim 1, further comprising a frame surrounding said receiving space.

4. The installation according to claim 1, further comprising the treadmill positioned within said receiving space.

5. The installation according to claim 4, further comprising a pair of railings positioned in space relation on opposite sides of said treadmill.

6. The installation according to claim 4, further comprising:

a motor positioned adjacent to a closed end of said duct opposite said open end of said duct;

a mechanical transmission extending through said duct, said mechanical transmission connecting said motor to said treadmill for providing motive power thereto.

7. The installation according to claim 6, wherein said mechanical transmission comprises a pulley assembly.

8. The installation according to claim 1, further comprising a plurality of studs attached to and extending from said pan.

9. The installation according to claim 1, comprising four of said side panels.

10. The installation of claim 1, wherein said duct extends transversely to a roller of said treadmill, and wherein said sidewall of said pool structure comprises formed concrete.

11. A pool structure, said pool structure comprising:

a pool floor;

a plurality of sidewalls attached to one another and said pool floor, said sidewalls extending transversely to said pool floor and defining a water receiving volume therebetween;

a first pan attached to said pool floor adjacent to one of said sidewalls, said first pan comprising a first floor panel and a plurality of first side panels attached thereto, said first side panels extending transversely to said first floor panel and defining a first receiving space between said first floor panel and said first side panels;

a first opening positioned in one of said first side panels;

a first duct having an open end attached to said first pan at said first opening, said first duct extending transversely to said one first side panel and through said one sidewall adjacent to said first pan, thereby positioning an opposite end of said first duct outside of said water receiving volume.

12. The pool structure according to claim 11, further comprising a first treadmill positioned within said first receiving space.

13. The pool structure according to claim 12, further comprising a pair of railings positioned in spaced relation on opposite sides of said first treadmill.

14. The pool structure according to claim 12, further comprising:

a motor positioned adjacent to said first duct;

a mechanical transmission extending through said first duct, said mechanical transmission connecting said motor to said first treadmill for providing motive power thereto.

15. The pool structure according to claim 14, wherein said mechanical transmission comprises a pulley assembly.

16. The pool structure according to claim 12, further comprising a jet port positioned in said one sidewall adjacent to said first pan, said jet port being aligned with said first treadmill.

17. The pool structure according to claim 12, wherein said first pan is embedded within said pool floor.

18. The pool structure according to claim 17, further comprising a plurality of studs attached to and extending from said first pan, said studs being embedded within said pool floor.

19. The pool structure according to claim 17, wherein said pool floor has an upper surface, said first treadmill having a belt positioned flush with said upper surface.

20. The pool structure according to claim 19, further comprising a frame surrounding said first treadmill.

21. The pool structure according to claim 20, wherein said frame is positioned flush with said upper surface.

22. The pool structure according to claim 12, said pool structure further comprising:

a second pan attached to said pool floor adjacent to one of said sidewalls, said second pan comprising a second floor panel and a plurality of second side panels attached thereto, said second side panels extending transversely to said second floor panel and defining a second receiving space between said second floor panel and said second side panels;

a second opening positioned in one of said second side panels;

a second duct having an open end attached to second pan at said second opening, said second duct extending transversely to said one second side panel and through said one sidewall adjacent to said second pan, thereby positioning an opposite end of second duct outside of said water receiving volume.

23. The pool structure according to claim 22, further comprising a second treadmill positioned within said second receiving space.

24. The pool structure according to claim 23, further comprising a pair of railings positioned in spaced relation on opposite sides of said second treadmill.

25. The pool structure according to claim 23, further comprising:

a motor positioned adjacent to said second duct;

a mechanical transmission extending through said second duct, said mechanical transmission connecting said motor to said second treadmill for providing motive power thereto.

26. The pool structure according to claim 25, wherein said mechanical transmission comprises a pulley assembly.

27. The pool structure according to claim 23, further comprising a jet port positioned in said one sidewall adjacent to said second pan, said jet port being aligned with said second treadmill.

28. The pool structure according to claim 23, wherein said second pan is embedded within said pool floor.

29. The pool structure according to claim 28, further comprising a plurality of studs attached to and extending from said second pan, said studs being embedded within said pool floor.

30. The pool structure according to claim 28, wherein said pool floor has an upper surface, said second treadmill having a belt positioned flush with said upper surface.

31. The pool structure according to claim 30, further comprising a frame surrounding said second treadmill.

32. The pool structure according to claim 31, wherein said frame is positioned flush with said upper surface.

33. The pool structure according to claim 22, further comprising a plurality of mounting brackets affixed to said second floor panel.

34. The pool structure according to claim 11, further comprising a plurality of mounting brackets affixed to said first floor panel.

35. The pool structure according to claim 11, wherein said pool floor and said plurality of sidewalls are formed of concrete, gunite or shotcrete.

36. A pool structure, said pool structure comprising:

a pool floor;

a plurality of sidewalls attached to one another and said pool floor, said sidewalls extending transversely to said pool floor and defining a water receiving volume therebetween;

a first pan attached to said pool floor adjacent to one of said sidewalls, said first pan comprising a first floor panel and a plurality of first side panels attached thereto, said first side panels extending transversely to said first floor panel and defining a first receiving space between said first floor panel and said first side panels;

a first opening positioned in one of said first side panels;

a first duct having an open end attached to said first pan at said first opening, said first duct extending transversely to said one first side panel and through said one sidewall adjacent to said first pan, thereby positioning an opposite end of said first duct outside of said water receiving volume;

a second pan attached to said pool floor adjacent to one of said sidewalls, said second pan comprising a second floor panel and a plurality of second side panels attached thereto, said second side panels extending transversely to said second floor panel and defining a second receiving space between said second floor panel and said second side panels;

a second opening positioned in one of said second side panels;

a second duct having an open end attached to said second pan at said second opening, said second duct extending transversely to said one of said second side panels and through said one sidewall adjacent to said second pan, thereby positioning an opposite end of said second duct outside of said water receiving volume.

37. The pool structure according to claim 36, further comprising a first treadmill positioned within said first receiving space and a second treadmill positioned within said second receiving space.

38. The pool structure according to claim 37, wherein said first and second pans are embedded within said pool floor.

39. The pool structure according to claim 38, further comprising a plurality of studs attached to and extending from said first and second pans, said studs being embedded within said pool floor.

40. The pool structure according to claim 38, wherein said pool floor comprises a first upper surface portion positioned at a first level and a second upper surface portion positioned at a second level, said second level being higher relative to said first level, said first pan being surrounded by said first upper surface portion and said second pan being surrounded by said second upper surface portion.

41. The pool structure according to claim 40, wherein said first treadmill has a belt positioned flush with said first upper surface portion and said second treadmill has a belt positioned flush with said second upper surface portion.

42. The pool structure according to claim 41, further comprising a first frame surrounding said first treadmill and a second frame surrounding said second treadmill.

43. The pool structure according to claim 42, wherein said first frame is positioned flush with said first upper surface portion and said second frame is positioned flush with said second upper surface portion.

44. The pool structure according to claim 37, further comprising:

a first motor positioned adjacent to said first duct;

a first mechanical transmission extending through said first duct, said first mechanical transmission connecting said first motor to said first treadmill for providing motive power thereto;

a second motor positioned adjacent to said second duct;

a second mechanical transmission extending through said second duct, said second mechanical transmission connecting said second motor to said second treadmill for providing motive power thereto.

45. The pool structure according to claim 44, wherein said first mechanical transmission comprises a first pulley assembly and said second mechanical transmission comprises a second pulley assembly.

46. The pool structure according to claim 37, further comprising a first pair of railings positioned in spaced relation on opposite sides of said first treadmill and a second pair of railings positioned in spaced relation on opposite sides of said second treadmill.

47. The pool structure according to claim 37, further comprising a first jet port positioned in said one sidewall adjacent to said first pan, said first jet port being aligned with said first treadmill, and a second jet port positioned in said one sidewall adjacent to said second pan, said second jet port being aligned with said second treadmill.

48. The pool structure according to claim 36, wherein said pool floor and said plurality of sidewalls are formed of concrete, gunite or shotcrete.

* * * * *